United States Patent [19]

Doyel

[11] 4,398,237

[45] Aug. 9, 1983

[54] MINIATURE BATTERY-OPERATED LIGHT

[76] Inventor: John S. Doyel, 404 W. 20th St., New York, N.Y. 10011

[21] Appl. No.: 341,203

[22] Filed: Jan. 21, 1982

[51] Int. Cl.[3] ..... F21L 7/00

[52] U.S. Cl. ..... 362/186; 362/196; 362/200; 362/202; 362/205; 362/206; 362/374; 362/375; 200/60

[58] Field of Search ..... 362/186, 196, 200, 202, 362/205, 206, 374, 375; 200/60

[56] References Cited

U.S. PATENT DOCUMENTS

| | | | |
|---|---|---|---|
| 2,089,897 | 8/1937 | Jodkins | 362/200 |
| 4,034,213 | 7/1977 | Norris | 362/101 X |
| 4,261,026 | 4/1981 | Bolha | 362/101 |
| 4,336,574 | 6/1982 | Goodhan | 362/200 |

*Primary Examiner*—Stephen J. Lechert, Jr.

[57] ABSTRACT

Disclosed is a miniature battery-operated light which, except for the necessary batteries, bulb and electrical contacts, is entirely made of molded pieces of thermoplastic material assembled manually by snap-fit or friction-fit. The same housing can be used either with a lid assembly having a flashlight reflector or with a smaller lid assembly without a reflector.

5 Claims, 9 Drawing Figures

Fig. 1.
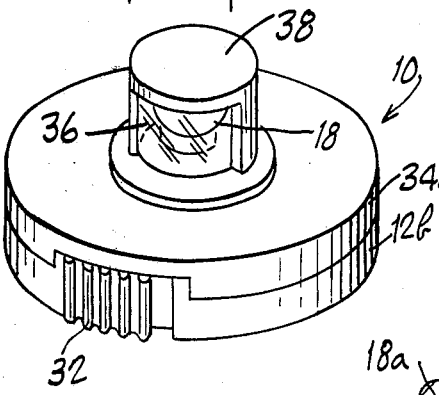
Fig. 2.
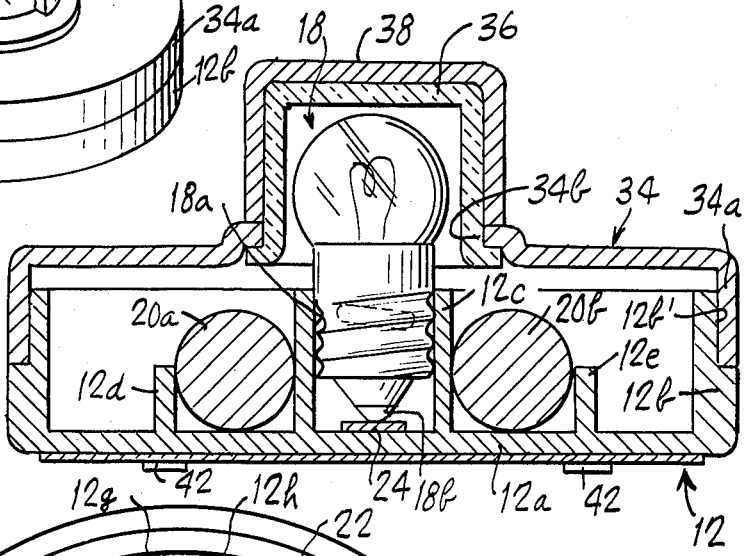
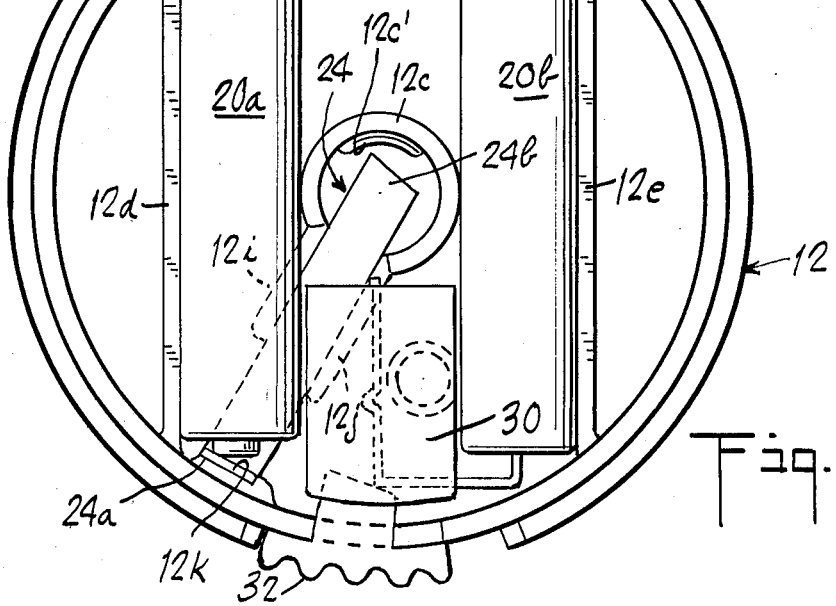
Fig. 3.

Fig. 4.
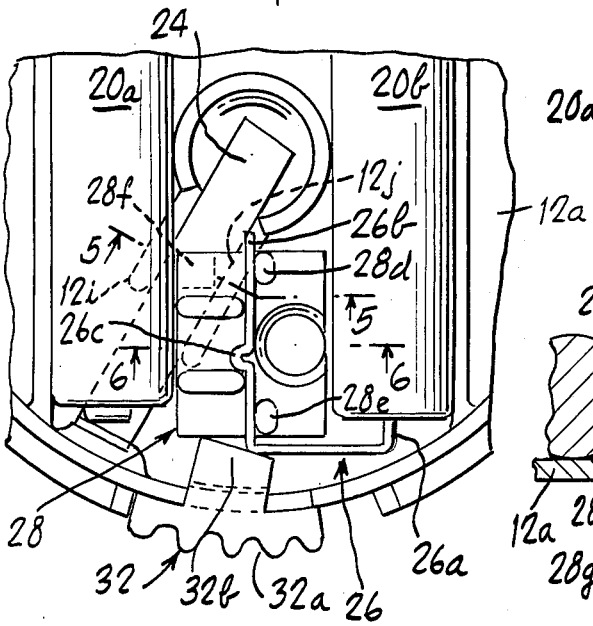
Fig. 5.
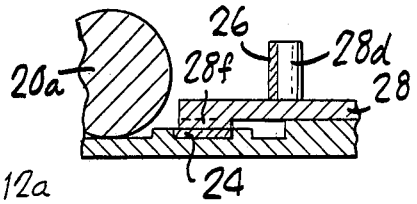
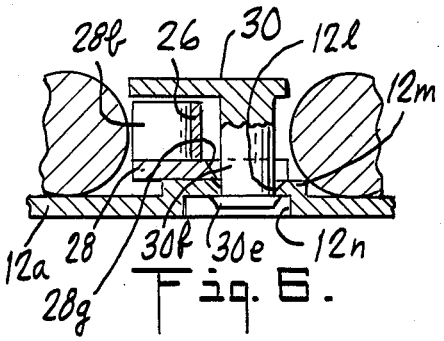
Fig. 6.
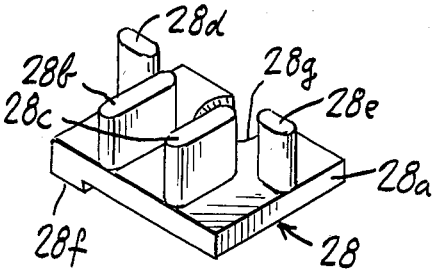
Fig. 7.
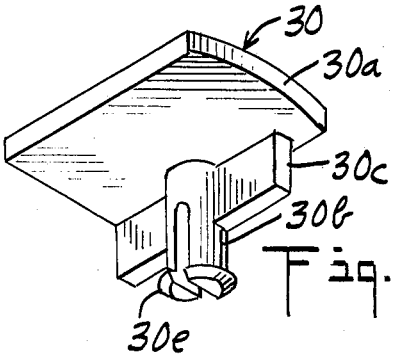
Fig. 8.
Fig. 9.
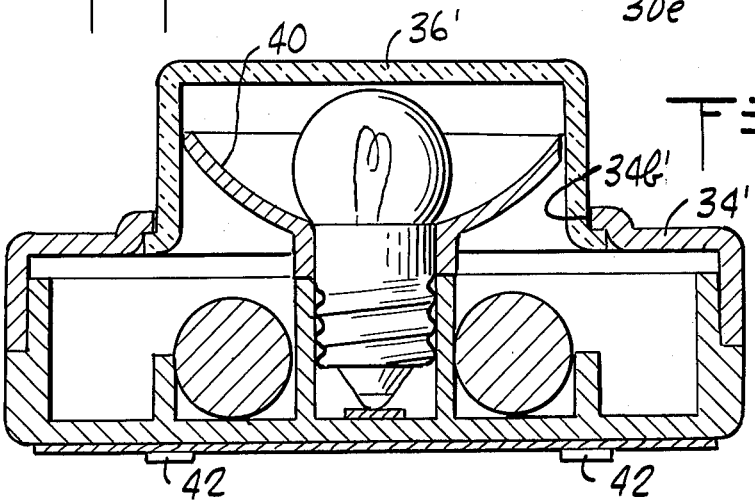

MINIATURE BATTERY-OPERATED LIGHT

BACKGROUND AND SUMMARY OF THE INVENTION

The invention is in the field of miniature battery-operated lights and particularly those made of inexpensive, molded thermoplastic components. Its main object is to provide a light which is particularly convenient and inexpensive to assemble from molded thermoplastic components and which easily lends itself to inexpensive and convenient conversion between a first embodiment in which it has a smaller lid without a bulb reflector and a second embodiment in which it has a larger lid assembly with a bulb reflector enabling it to serve as a flashlight. Other objects and advantages of the invention will become apparent from the detailed description below.

BRIEF DESCRIPTION OF THE DRAWINGS

FIG. 1 is a perspective view of a miniature light illustrating one embodiment of the invention.

FIG. 2 is a cross-sectional view thereof.

FIG. 3 is a top plan view of the portion of the light remaining after the removal of a lid assembly and a bulb.

FIG. 4 is a partial top plan view of the portion remaining after removal of the lid assembly, bulb, and the top part of a moving contact guide assembly.

FIG. 5 is a partial sectional view taken along line 5—5 of FIG. 4.

FIG. 6 is a partial sectional view taken along line 6—6 of FIG. 4.

FIG. 7 is a perspective view of the bottom part of the moving contact guide assembly.

FIG. 8 is a perspective view of the top part of the moving contact guide assembly.

FIG. 9 is a cross-sectional view, smaller to that of FIG. 2, but of a flashlight illustrating an alternative embodiment of the invention.

DETAILED DESCRIPTION

FIG. 1 illustrates a light 10 which, as detailed in FIG. 2, comprises a housing 12 and a lid assembly 14. Housing 12 is shallow, open-top and generally can-shaped and comprises a bottom wall 12*a* and a circumferential sidewall 12*b*. The entire housing is integrally molded as a single piece, and includes an open-top bulb socket 12*c* and a pair of open-top battery channels which flank socket 12*c* and are defined by the socket and respective ribs 12*d* and 12*e* which extend upwardly from bottom wall 12*a*. A bulb 18 having side contact 18*a* and bottom contact 18*b* is received into bulb socket 12*c* (note projection 12*c*' therein which serves as a screw thread), and batteries 20*a* and 20*b* friction-fit between rib 12*d* and socket 12*c* and between socket 12*c* and rib 12*e*, respectively. Another rib, 12*f*, extends upwardly from a rear portion of bottom wall 12*a* and faces projections 12*g* and 12*h* extending forwardly from sidewall 12*b*. A metal strip 22, serving as a back contact, is friction fitted into housing 12 by inserting it from the top down into the space between projections 12*g* and 12*h* on the one hand and rib 12*f* on the other. Back contact 22 is bow-shaped and makes electrical contact with the rearwardly facing ends of batteries 20*a* and 20*b*. Another metal strip, 24, runs along the top side of bottom wall 12*a* from the bottom of bulb socket 12*c* to the front end of the battery well defined between rib 12*d* and socket 12*c*. Strip 24 serves as an underlying contact, and has an upwardly extending front end 24*a* making electrical contact with the forwardly facing end of battery 20*a* and a battery end, 24*b*, which makes electrical contact with the bottom contact 18*b* of bulb 18. Underlying contact 24 is centered in its position between two short ribs 12*i* and 12*j* which extend upwardly from bottom wall 12*a*, and its upwardly extending battery end 24*a* is in a suitably shaped cradle 12*k* formed by a generally rearwardly extending projection from sidewall 12*b*.

A third metal strip, 26, serves as a moving contact and has a battery end 26*a* which makes electrical contact with the forwardly facing end of battery 20*b* and a bulb end 26*b* which faces side contact 18*a* of bulb 18 but does not make electrical contact therewith unless deformed against its bias. Moving contact 26 is in a guide assembly comprising a bottom part generally indicated at 28 and a top part generally indicated at 10. The bottom part comprises a pad 28*a*, pins 28*b*, 28*c*, 28*d* and 28*e* extending upwardly therefrom, and a foot 28*f* extending downwardly from one corner thereof. A portion of moving contact 26 is forced down between pins 28*b* and 28*c* on the one hand and 28*d* and 28*e* on the other hand, to the position shown in FIG. 4, and the guide assembly is then put together by snap-fitting parts 28 and 30. To this end top part 30 comprises a pad 30*a* and a pin 30*b* and rib 30*c* each downwardly extending therefrom. Pin 30*b* has a split bottom end and barbs 30*d* and 30*e*, and pad 28 has an opening 28*g* allowing passage of the bottom portion of pin 30*b*. Once moving contact 26 is positioned in part 28, part 30 is placed on top thereof to form the guide assembly, with pin 30*b* extending downwardly through opening 28*g* and with contact 20*c* remaining between pads 28*a* and 30*a* as best seen in FIG. 6. The guide assembly and moving contact 26 is then snap-fitted to housing 12 by forcing the bottom end of pin 30*b* through an opening 12*l* in bottom wall 12 until barbs 13*d* and 13*e* clear it. Opening 12*l* is in a raised pad 12*m* of bottom wall 12, which leaves an opening 12*n* to accommodate barbs 30*d* and 30*e* and allow the main part of bottom wall 12*n* to be flush with a flat surface on which the flashlight may be placed. Foot 28*f* just clears rib 12*j* and holds down underlying contact 24 to keep it pressed against bottom wall 12*a*. Moving contact 26 has a bend at 26*c*, as best seen in FIG. 4, which is between pins 28*b* and 28*c* to limit the movement of contact 26 toward and away from bulb 18.

A switch generally indicated at 32 fits over sidewall 12*b* and has projections extending downwardly along both sides of sidewall 12*b* so as to stay thereon as it slides therealong. Switch 32 has a serrated outer portion 32*a* and a cam 32*b* engaging moving contact 26, and has an OFF position, in which it is shown in FIGS. 3 and 4 and in which it allows moving contact 26 to be in the shown position and out of electrical contact with side contact 18*a* of bulb 18. Switch 32 can be manually slid along sidewall 12*b* to an ON position which is to the right as viewed in FIGS. 3 and 4, to thereby have its cam 32*b* force moving contact 26 to bend against the bias thereof such that its bulb end 26*b* moves toward bulb 18 and makes electrical contact with its side contact 18*a*, whereupon the bulb is placed in a series connection with batteries 20*a* and 20*b* and lights up. When contact 32 is manually returned to the OFF position shown in FIGS. 3 and 4, the spring bias of moving contact 26 returns it to the shown position in which its end 26*b* does not make electrical contact with side contact 18*a* of bulb 18.

Housing 12 is covered with a lid 34 friction-fitted over a recessed portion 12*b*′ of sidewall 12 such that the outside of sidewall 12*b* and the outside of sidewall 34*a* of lid 34 are flush with each other. Lid 34 has a central opening 34*b*, and a transparent bulb cap 36 is friction-fitted therein prior to fitting lid 34 onto housing 12. An opaque hood 38 is in turn friction-fitted over cap 36 so as to allow light from bulb 18 to emanate only through the shown exposed portion of cap 36. The friction fit between cap 36 and hood 38 is sufficiently loose to allow the user to easily rotate hood 38 around cap 36 and to easily remove and reinstall hood 38.

Referring to FIG. 9, the modified embodiment illustrated therein serves as a flashlight and differs from the one discussed above in connection with FIGS. 1–8 only in that its lid 34′ has a central opening 34*b*′ sufficiently large to accommodate a larger transparent bulb cap 36′ and in that a reflector 40 is provided. The surface of reflector 40 illuminated by bulb 18 has a light reflective coating.

Except for the parts which conduct electricity, the light shown in FIGS. 1–8 is made of only seven pieces each of which is integrally molded of thermoplastic material, as by injection molding: housing 12, lid 34, transparent cap 36, hood 38, bottom and top parts 28 and 30 of the moving contact guide, and switch 32. In the embodiment of FIG. 9 the number of molded pieces is the same, as it has an additional reflector 40 but does not have a hood corresponding to hood 38.

The light of FIGS. 1–8 can be assembled entirely by hand, without using any tools. The bottom part is assembled by forcing back contact 22 between rib 12*f* and projections 12*g* and 12*h* to the positions shown in FIG. 3, placing underlying contact 24 in the channel therefor formed between ribs 12*i* and 12*j*, forcing moving contact 26 between pins 28*b* and *c* and 28*d* and *e* to the position shown in FIG. 4. The moving contact guide is assembled by forcing pin 30*b* through opening 28*g*, placing cam 32*b* between pads 30*a* and 28*a* and then positioning the combination of switch 32 and the guide assembly and contact 26 into housing 12 by saddling contact 32 onto sidewall 12*b* and forcing end 30*b* of pin 30 through opening 12*l* into a snap-fit, screwing bulb 18 into socket 12*c* (which has an integrally molded inwardly extending projection 12*c*′ mating with screw threads on bulb 18), at which time the bottom part of the light is ready for loading with batteries. The top part is assembled by friction-fitting cap 36 into opening 34*b* of lid 34, and friction-fitting hood 38 onto cap 36. Assembly is then completed by friction-fitting lid 34 onto housing 12. The embodiment illustrated in FIG. 9 is assembled in the same manner except that reflector 40 is placed onto socket 12*c* before bulb 18 is screwed in place, and except that there is no hood over the larger lens cap 36′.

Either of the embodiments of FIGS. 1–8 or FIG. 9 can be used as a hand-held light or by supporting it in some other way. In the alternative, either can be provided with adhesive strips or pads, such as at 42, allowing the light to be adhesively mounted on a surface such as a closet door or an automobile dashboard. Hood 38 can be used as a lamp shade, or to make the light more convenient as, for example, a map or a reading light.

I claim:

1. A light comprising:

a shallow, open-top, can-shaped housing having a bottom wall, a circumferential sidewall, a centrally located, open-top bulb socket having a generally smooth interior except for a single, boss-shaped, radially inwardly extending projection serving the function of a thread for a threaded bulb having a bottom contact and a side contact, a pair of open-top battery channels flanking the socket, a retainer for a back contact, a retainer for an underlying contact and a retainer for a guide for a moving contact, wherein the entire housing, together with its bulb socket, battery channels and retainers, is made of a thermoplastic material integrally molded into a single piece;

a back contact retained in the housing retainer therefor adjacent a back end of said channels to make electrical contact with the rearwardly facing ends of batteries inserted in the channels, an underlying contact retained in the housing retainer therefor and having a battery end disposed at the front end of one of said channels to make electrical contact with the forwardly facing end of a battery inserted therein and a bulb end disposed at the bottom of said socket to make electrical contact with the bottom contact of a bulb inserted therein, and a guide for a moving contact retained in the housing retainer therefor and a moving contact guided by said guide and having a battery end disposed adjacent the front end of the other one of said battery channels to make electrical contact with the forwardly facing end of a battery inserted therein and a bulb end facing but biased away from the side contact of a bulb inserted in said bulb socket;

a manual switch mounted on said housing for movement between an ON position in which it deforms said moving contact against the bias thereof to force its bulb end into electrical contact with the side contact of a bulb inserted in said socket and to thereby complete an electrical circuit comprising said batteries, back, underlying and moving contacts and said bulb to thereby energize the bulb, and an OFF position in which it allows the bias of said moving contact to break electrical contact with the side contact of a bulb inserted in said socket and thereby de-energize the bulb; and a lid closing the open-top housing to thereby enclose said contacts, batteries inserted in said channels and bulb inserted in said socket but to allow manual access to said switch, said lid having a transparent bulb cap allowing illumination of the ambient by said bulb;

all of said light, except for the contacts and for the batteries and bulb inserted therein, being made of molded thermoplastic material components manually fitted together by snap- and/or friction-fit to form the assembled light.

2. A light as in claim 1 including a flashlight reflector enclosed within said light and having a concave reflective surface which is within said transparent bulb cap and is coaxial with said bulb socket and surrounds a bulb inserted therein.

3. A light as in claim 1 in which the guide for the moving contact is secured to said housing by a snap-fit thereto and guides said moving contact in its movement between its OFF and ON positions.

4. A light as in claim 3 in which said socket includes a radially inwardly extending projection serving as thread for screwing a threaded bulb therein and wherein said housing comprises the bottom wall, sidewall, bulb socket, battery channels, a back contact retainer, and underlying contact retainer and a moving contact guide retainer and is integrally formed of a single piece of molded thermoplastic material.

5. A light as in claim 1 including an opaque bulb hood friction-fitted over said transparent bulb cap to rotate about the axis of said reflector and having an opening allowing escape of light through said cap only in a selected direction which is generally transverse to said axis.

* * * * *